US006959628B2

(12) United States Patent
Macor

(10) Patent No.: US 6,959,628 B2
(45) Date of Patent: Nov. 1, 2005

(54) HANDLE SHROUD FOR DOUBLE-ENDED WRENCHES

(75) Inventor: Richard J. Macor, Hunterdon County, NJ (US)

(73) Assignee: Proprietary Technologies, Inc., Hunterdon County, NJ (US)

( * ) Notice: Subject to any disclaimer, the term of this patent is extended or adjusted under 35 U.S.C. 154(b) by 45 days.

(21) Appl. No.: 10/699,272

(22) Filed: Oct. 31, 2003

(65) Prior Publication Data

US 2004/0089114 A1 May 13, 2004

Related U.S. Application Data

(63) Continuation-in-part of application No. 10/241,100, filed on Sep. 11, 2002, now Pat. No. 6,792,833, which is a continuation-in-part of application No. 10/226,055, filed on Aug. 22, 2002, now Pat. No. 6,655,239.

(51) Int. Cl.[7] ..... B25B 13/02

(52) U.S. Cl. ..... 81/125.1; 81/124.3; 81/177.1

(58) Field of Search ..... 81/125.1, 177.1, 81/180.1, 184, 489; 16/421, 430, DIG. 12

(56) References Cited

U.S. PATENT DOCUMENTS

| | | | | |
|---|---|---|---|---|
| 1,793,714 | A | | 2/1931 | Newberg |
| 4,576,207 | A | * | 3/1986 | Levine et al. ..... 16/421 |
| 5,771,535 | A | * | 6/1998 | Blessing ..... 16/430 |
| D434,292 | S | | 11/2000 | Hsieh |
| 6,240,600 | B1 | * | 6/2001 | Petruska, Jr. ..... 16/421 |
| 6,405,619 | B1 | * | 6/2002 | Lamond et al. ..... 81/177.1 |
| 6,823,562 | B1 | * | 11/2004 | Smith et al. ..... 16/421 |
| 2004/0206213 | A1 | * | 10/2004 | Hsien ..... 81/125.1 |

* cited by examiner

*Primary Examiner*—Debra S Meislin

(57) ABSTRACT

A handle shroud for use with a double-ended wrench having a twisted handle configuration is described. The handle shroud is formed to substantially cover at least a portion of the twisted handle of the double-ended wrench so as to improve user comfort and ergonomics. The handle shroud is further formed being at least partially hollow and comprising an elongated opening at each end thereof with each elongated opening having a predetermined direction of elongation. And, the direction of elongation of one opening is substantially perpendicular to the direction of elongation of the other opening. In some preferred embodiments, the handle shroud is externally formed being substantially non-twisted.

8 Claims, 3 Drawing Sheets

HANDLE SHROUD FOR DOUBLE-ENDED WRENCHES

REFERENCES TO RELATED APPLICATIONS

This application relates to and is a Continuation-In-Part of U.S. patent application Ser. No. 10/241,100 filed on Sep. 11, 2002 now U.S. Pat. No. 6,792,833, entitled "Double-ended wrench with ergonomic handle portions" which is a Continuation-In-Part of U.S. patent application Ser. No. 10/226,055, filed on Aug. 22, 2002 now U.S. Pat. No. 6,655,239, entitled "Double-ended wrench with ergonomic handle"; all of which have been filed for by the inventor herein.

FIELD OF THE INVENTION

The present invention relates to a handle shroud that may be used in combination with a hand operated double-ended wrench including combination wrenches, box wrenches, open end wrenches, flex head wrenches and the like.

BACKGROUND OF THE INVENTION

Hand operated double-ended wrenches have been around for many years and they are typically structured having an elongated, flat shaped handle with a wrench head at each end for turning various fasteners. Typical variations include combination, double box, double open-end, flex-head type and the like. The flat shaped handle connected to each wrench head provides each wrench head with excellent accessibility to fasteners. It is, however, the flat shaped handle that creates a major disadvantage associated with this tool. The thin handle provides only a minimal surface area for the application of force by a user to turn and operate the wrench. This minimal surface area creates user discomfort and fatigue, while limiting torque and continuous-use capabilities. There have been attempts to address this identified deficiency with the creation of a double-ended wrench having a twisted handle configuration. The twisted handle configuration does provide some advantages including a greater surface area for the application of force by a user at each end of the wrench. However, the twisted handle configuration creates other disadvantages including a reduction in user comfort and ergonomics around the twisted area of the wrench. In addition, applicant believes that a user may perceive a twisted double-ended wrench as a wrench which is damaged or rejected by the manufacturer.

Accordingly, it is believed there is a need to improve upon prior art double-ended flat wrenches, including those wrenches which have a "twisted" handle configuration. Applicant contemplates an improved wrench that comprises a present invention handle shroud formed to cover and structurally change a double-ended twisted wrench at its twisted area, so as to improve user comfort, ergonomics and the appearance of the wrench.

SUMMARY OF THE INVENTION

The present invention involves a handle shroud for use with a double-ended wrench having a twisted handle configuration. The handle shroud is externally formed substantially non-twisted and to substantially cover at least a portion of the twisted handle of the double-ended wrench so as to improve user comfort and ergonomics. The handle shroud is further formed being at least partially hollow and comprising an elongated opening at each end thereof with each elongated opening having a predetermined direction of elongation. The direction of elongation of one opening is substantially perpendicular to the direction of elongation of the other opening. And, each end is further formed being substantially tapered with the tapering of one end formed substantially perpendicular to the tapering of the other end.

Applicant has identified the need to improve upon prior art, double-ended flat wrenches including those having a twisted handle configuration. Accordingly, applicant seeks to achieve the following objectives.

It is an important objective of the present invention described above, that a handle shroud be formed to substantially cover and structurally change a double-ended twisted wrench at its twisted area, so as to improve user comfort and ergonomics.

It is an important objective of the present invention described above, that the handle shroud be formed to substantially cover and structurally change a double-ended twisted wrench at its twisted area, so as to improve the appearance of the twisted wrench.

It is another important objective of the present invention described above, that it be durable in its intended market environment.

And, it is yet another important objective of the present invention described above, that it be cost efficient to manufacture and commercially viable.

DETAILED DESCRIPTION OF THE DRAWINGS

Figure 1:
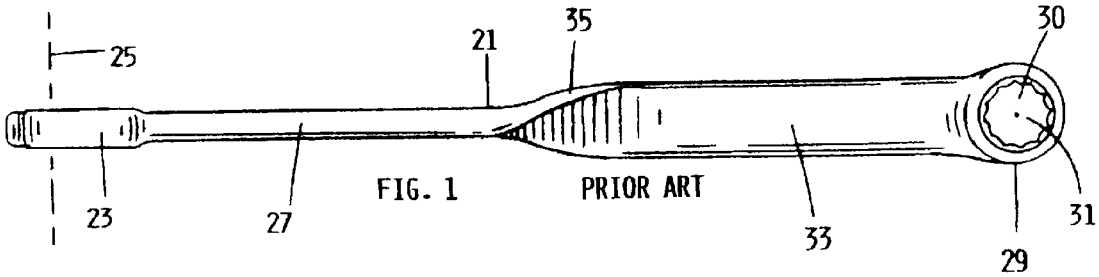
FIG. 1 PRIOR ART
FIG. 1 shows a left side, elevational view of a prior art double-ended wrench with twisted handle configuration.
Figure 2:
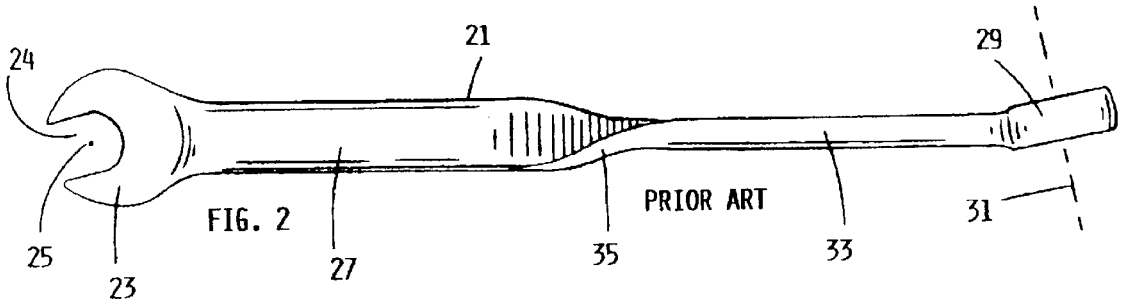
FIG. 2 PRIOR ART
FIG. 2 shows a top plan view of the double-ended wrench shown in FIG. 1.

Referring now to the drawings which are for the purpose of illustrating preferred embodiments of the present invention and not for the purpose of limiting same, FIG. 1 shows a left side, elevational view of a prior art, double-ended wrench with twisted handle configuration; and, FIG. 2 shows a top plan view of the wrench shown in FIG. 1. Referring to FIGS. 1 and 2 together, wrench 21 comprises a first wrench head 23 positioned at one end thereof and a second wrench head 29 positioned at the other end thereof. The first wrench head 23 has an orifice 24 (not seen in FIG. 1) formed for engagement with various fasteners and the orifice has an imaginary central axis of wrench rotation 25.

The first wrench head 23 is connected a first handle portion 27 which is relatively thin (as seen in FIG. 1) so that wrench head 23 can easily access and engage with fasteners located in common or limited-access environments. The second wrench head 29 has an orifice 30 formed for engagement with various fasteners and orifice 30 has an imaginary central axis of wrench rotation 31. The second wrench head 29 is connected to a second handle portion 33. When operating wrench 21, a user will generally grip handle portion 33 to turn wrench head 23 about imaginary central axis 25 to turn various fasteners. Alternatively, a user may grip handle portion 27 to turn wrench head 29 about imaginary central axis 31 to turn various fasteners. First handle portion 27 is connected to second handle portion 33 at twisted handle portion 35. This prior art, wrench handle configuration does provide some advantages including a greater surface area for the application of force by a user at each end of the wrench. However, the twisted handle configuration is uncomfortable and awkward for users especially around twisted area 35 of wrench 41. In addition, applicant believes that a user may perceive a double-ended wrench with such a twisted handle configuration as being damaged or rejected by the manufacturer.

Figure 3:
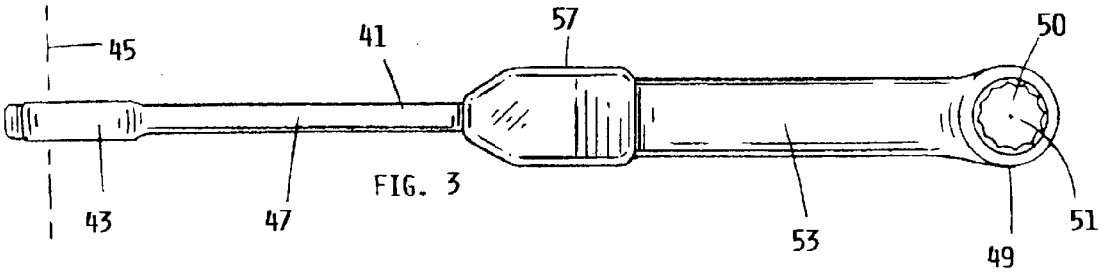
FIG. 3 shows a left side, elevational view of a present invention double-ended wrench with handle shroud.

FIG. 3 shows a left side, elevational view of a present invention double-ended wrench with handle shroud. Double-ended wrench 41 is shown with a first wrench head 43 having an axis of wrench rotation 45, and a second wrench head 49 having an axis of wrench rotation 51. Wrench 41 has a first handle portion 47 connecting to the first wrench head 43, and, a second handle portion 53 connecting to wrench head 49. Handle shroud 57 is positioned on wrench 41 covering a portion of the handle.

Figure 4:
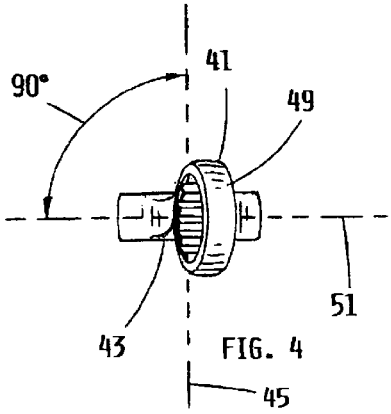
FIG. 4 shows a rear end view of the double-ended wrench shown in FIG. 3.

FIG. 4 shows a rear end view of the double-ended wrench shown in FIG. 3. It can be seen in this end view that the orientation of one wrench head is positioned relative to the other wrench head, whereas, the axis of wrench rotation 45 of first wrench head 43 is substantially perpendicular to the axis of wrench rotation 51 of second wrench head 49.

Figure 5:
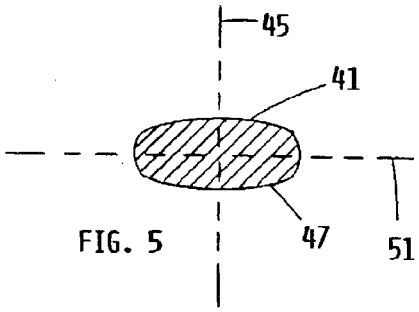
FIG. 5 shows a cross-sectional, end view of the first handle portion of the double-ended wrench shown in FIG. 3.
Figure 6:
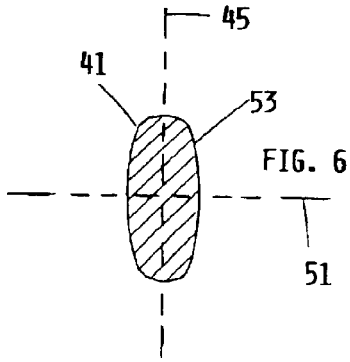
FIG. 6 shows a cross-sectional, end view of the second handle portion of the double-ended wrench shown in FIG. 3.

Referring now to FIGS. 5 and 6 together, FIG. 5 shows a cross-sectional, end view of the first handle portion of the double-ended wrench shown in FIG. 3; and, FIG. 6 shows a cross-sectional, end view of the second handle portion of the double-ended wrench shown in FIG. 3. It can be seen that first handle portion 47 (shown in FIG. 5) and second handle portion 53 (shown in FIG. 6) each have an elongated cross-sectional shape and each elongated cross-sectional shape has a direction of elongation. The cross-sectional shape of first handle portion 47 has a direction of elongation which is substantially perpendicular to axis of wrench rotation 45, while the cross-sectional shape of second handle portion 53 has a direction of elongation substantially parallel to axis of wrench rotation 45. Accordingly the elongated cross-sectional shape of first handle portion 47 has a direction of elongation which is substantially perpendicular to the direction of elongation of the elongated cross-sectional shape of the second handle portion 53.

Figure 7:
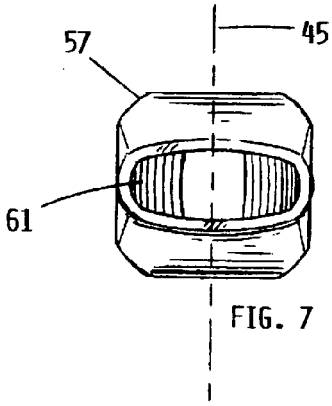
FIG. 7 shows a front end view of the present invention handle shroud shown in FIG. 3.
Figure 8:
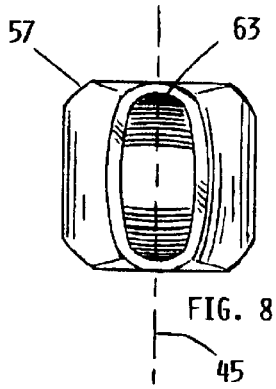
FIG. 8 shows a rear end view of the present invention handle shroud shown in FIG. 3.

Referring now to FIGS. 7 and 8 together, FIG. 7 shows a front end view of the present invention handle shroud shown in FIG. 3; and, FIG. 8 shows a rear end view of the present invention handle shroud shown in FIG. 3. In FIG. 7 handle shroud 57 has a front opening 61 which is elongated to accommodate the elongated cross-sectional shape of the first handle portion 47 of wrench 41 shown in FIG. 5. In FIG. 8, handle shroud 57 has a rear opening 63 which is elongated to accommodate the elongated cross-sectional shape of the second handle portion 53 of wrench 41 shown in FIG. 6. When looking at FIGS. 7 and 8 together, it can be seen that opening 61 of handle shroud 57 has a direction of elongation which is substantially perpendicular to axis of wrench rotation 45, while opening 63 as a direction of elongation substantially parallel to axis of wrench rotation 45. Accordingly, the front opening 61 of handle shroud 57 is elongated with a direction of elongation that is substantially perpendicular to the direction of elongation of the rear elongated opening 63 of handle shroud 57.

Figure 9:
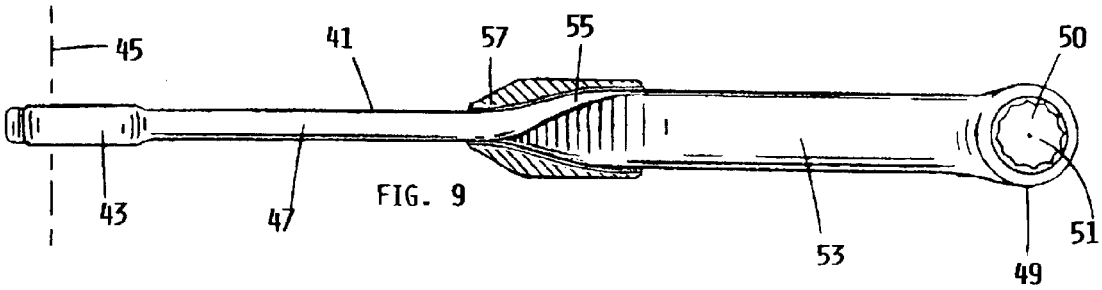
FIG. 9 shows the present invention double-ended wrench and handle shroud shown in FIG. 3, with the handle shroud shown in a cross-sectional view.

FIG. 9 shows the double-ended wrench and handle shroud shown in FIG. 3, with the handle shroud shown in a cross-sectional view.

Figure 10:
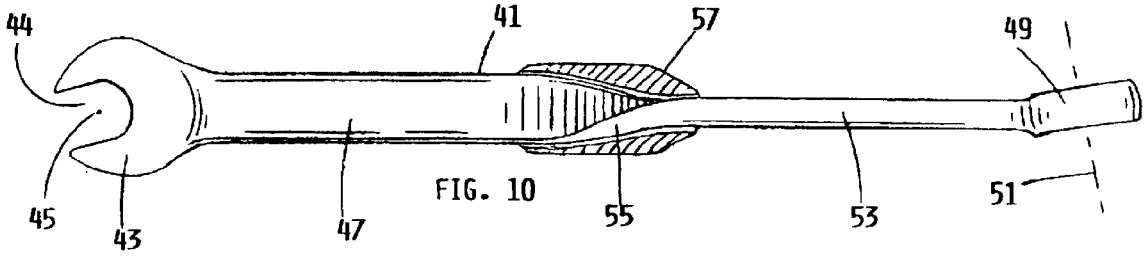
FIG. 10 shows a top plan view of the present invention double-ended wrench and handle shroud shown in FIG. 9.

FIG. 10 shows a top plan view of the double-ended wrench and handle shroud shown in FIG. 9. In this top plan view it is easy to see that shroud 57 is formed tapered in only one direction towards wrench head 49 as shown. And in the left side view thereof shown in FIG. 9 it is easy to see that shroud 57 is formed tapered in only one direction towards the opposite wrench head 43 as shown. This is because the tapering of one end of the present invention handle shroud is formed substantially perpendicular to the tapering of the other end. The word "taper" or "tapering" or "tapered" shall be defined herein as relating to a "decrease in width or thickness."

Referring now to the present invention double-ended wrench and handle shroud shown in FIGS. 3, 4, 5, 6, 7, 8, 9 and 10, it can be seen that double-ended wrench 41 comprises an elongated handle with at least a portion thereof twisted about an imaginary longitudinal axis. Wrench 41 has a first wrench head 43 positioned at one end, and a second wrench head 49 positioned at the other end thereof. Wrench head 43 has an orifice 44 with an imaginary axis of wrench rotation 45, and, wrench head 49 has an orifice 50 with an imaginary axis of wrench rotation 51. First wrench head 43 is positioned relative to the second wrench head 49, whereas, the axis of wrench rotation 45 of first wrench head 43 is substantially perpendicular to the axis of wrench rotation 51 of second wrench head 49. Wrench 41 further comprises a first handle portion 47 which connects to first wrench head 43, and a second handle portion 53 which connects to second wrench head 49. Each handle portion has an elongated cross-sectional shape when viewed in a cross-sectional plane perpendicular to the longitudinal direction of wrench 41 and each cross-sectional shape is elongated in a predetermined direction. First handle portion 47 is positioned relative to second handle portion 53 whereas the cross-sectional shape of the first handle portion 47 is elongated in a direction substantially perpendicular to the direction in which the cross-sectional shape of the second handle portion 53 is elongated. And, wrench 41 also comprises a handle shroud 57 which is formed to substantially cover at least a portion of the twisted handle area 55 of wrench 41 so as to improve user comfort and ergonomics. Handle shroud 57 further formed being at least partially hollow and comprising an elongated opening at each end thereof with each elongated opening having a predetermined direction of elongation. And, the direction of elongation of handle shroud opening 61 is substantially perpendicular to the direction of elongation of the other elongated opening 63 of handle shroud 57. Handle shroud 57 is externally formed being substantially non-twisted. Preferred embodiments of the present invention handle shroud are formed being externally non-twisted so as to cover the structurally twisted portion of the wrench handle with a handle portion that is structurally non-twisted.

It is logical to assume that the handle shroud can be made in a variety of different ways using a variety of different materials. Applicant contemplates preferred embodiments of the present invention being produced from a mold tool using a plastic type material. Other preferred embodiments may include a handle shroud formed to be fixedly attached to the handle of a double-ended wrench. Yet other preferred embodiments are contemplated including a handle shroud which is molded out of a plastic type material and formed as a single unit comprising two interconnecting "clam shell" halves joined by a hinge. This one piece embodiment could have interlocking pins that snap into counterpart receiving cavities. Yet another handle shroud embodiment is contemplated wherein the handle shroud is molded from a plastic type material and formed as two separate parts which are joined together using fastening hardware (Phillips screw, etc.), or by integral interlocking pins that snap into counterpart receiving cavities.

Figure 11:
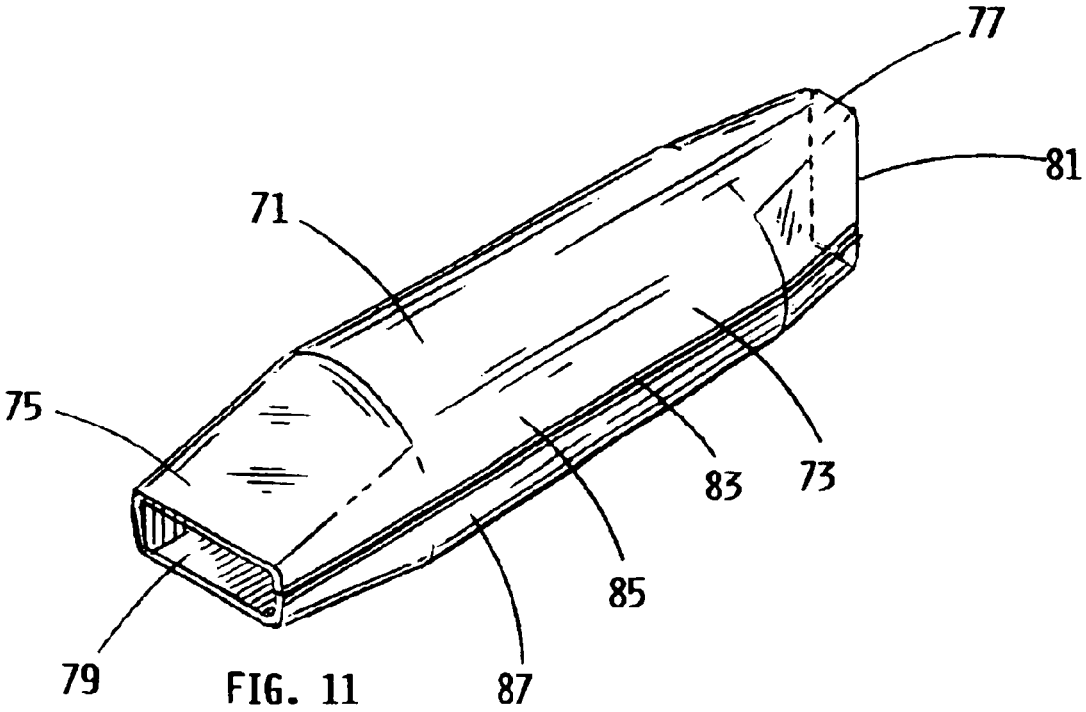
FIG. 11 shows another embodiment of the present invention handle shroud.

FIG. 11 shows another possible embodiment of the present invention handle shroud. In this embodiment shown, the handle shroud 71 is externally formed non-twisted with a barrel shaped mid-section 73 and tapering ends 75 and 77. Handle shroud 71 is further formed being at least partially hollow and comprising an elongated opening 79 at tapering end 75 and an elongated opening 81 (not fully seen in this view) at tapering end 77. It can be seen that each elongated opening has a direction of elongation with the direction of elongation of one opening being substantially perpendicular to the direction of elongation of the other opening. In this embodiment shown, handle shroud 71 has a seam 83 at which upper part 85 is joined to lower part 87 when both parts are snapped together onto a wrench. Handle shroud 71 is formed to substantially cover at least a portion of a twisted handle of a double-ended wrench so as to improve user comfort and ergonomics. In many embodiments, the handle shroud 71 may also act as a thumb-rest device, further adding to improved user manipulation and wrench control.

When considering the present invention, simplicity and obviousness should not be confused or considered the same. Accordingly, the novelty and complexity of the present invention must be measured by the many interrelated objectives set forth herein, including user control, manipulation, comfort and ergonomics, and, commercial viability.

Upon reading and understanding the specification of the present invention described above, modifications and alterations will become apparent to those skilled in the art. It is intended that all such modifications and alterations be included insofar as they come within the scope of the patent as claimed or the equivalence thereof.

Having thus described the invention, the following is claimed:

1. A double-ended wrench comprising:

an elongated handle formed with at least a portion thereof being twisted about an imaginary longitudinal axis, a first wrench head positioned at one end of said wrench and a second wrench head positioned at the other end thereof, each said wrench head having an orifice with an imaginary axis of wrench rotation, said first wrench head being positioned relative to said second wrench head whereas the axis of wrench rotation of said first wrench head is substantially perpendicular to the axis of wrench rotation of said second wrench head, said twisted elongated wrench handle comprising a first handle portion connecting to said first wrench head, and a second handle portion connecting to said second wrench head, each said handle portion having an elongated cross-sectional shape when viewed in a cross-sectional plane perpendicular to said longitudinal axis, each said cross-sectional shape being elongated in a predetermined direction, and, said first handle portion being positioned relative to said second handle portion whereas the cross-sectional shape of said first handle portion is elongated in a direction substantially perpendicular to the direction in which the cross-sectional shape of said second handle portion is elongated; and, A handle shroud being externally formed substantially non-twisted and to substantially cover at least a portion of the twisted handle of said double-ended wrench so as to improve user comfort and ergonomics, said handle shroud further being formed at least partially hollow and comprising an elongated opening at each end thereof with each said elongated opening having a predetermined direction of elongation, the direction of elongation of one said opening being substantially perpendicular to the direction of elongation of the other said opening, and, each said end further being formed substantially tapered with the tapering of one said end being formed substantially perpendicular to the tapering of the other said end.

2. The double-ended wrench of claim 1, wherein said handle shroud is formed from a mold tool.

3. The double-ended wrench of claim 1, wherein said handle shroud is formed to be fixedly attached to said elongated handle of said wrench.

4. The double-ended wrench of claim 1, wherein said handle shroud is formed as a single unit comprising two interconnecting halves joined by a hinge.

5. The double-ended wrench of claim 1, wherein said handle shroud is formed comprising at least two separate interconnecting parts.

6. The double-ended wrench of claim 2, wherein said handle shroud is formed to be fixedly attached to said elongated handle of said wrench.

7. The double-ended wrench of claim 2, wherein said handle shroud is formed as a single unit comprising two interconnecting halves joined by a hinge.

8. The double-ended wrench of claim 2, wherein said handle shroud is formed comprising least two separate interconnecting parts.

* * * * *